US007443099B2

(12) United States Patent
Song et al.

(10) Patent No.: US 7,443,099 B2
(45) Date of Patent: Oct. 28, 2008

(54) PLASMA DISPLAY PANEL

(75) Inventors: Sung-Ho Song, Suwon-si (KR); Jae-Ik Kwon, Suwon-si (KR); Woo-Tae Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 557 days.

(21) Appl. No.: 11/115,526

(22) Filed: Apr. 26, 2005

(65) Prior Publication Data

US 2005/0242728 A1 Nov. 3, 2005

(30) Foreign Application Priority Data

Apr. 29, 2004 (KR) ..... 10-2004-0029915

(51) Int. Cl.
*H01J 17/49* (2006.01)

(52) U.S. Cl. ..... 313/586; 313/582; 313/587

(58) Field of Classification Search ..... 313/582, 313/586, 587

See application file for complete search history.

(56) References Cited

U.S. PATENT DOCUMENTS

| | | | | |
|---|---|---|---|---|
| 5,640,068 | A | 6/1997 | Amemiya | |
| 7,154,222 | B2 * | 12/2006 | Woo et al. | 313/582 |
| 2004/0046505 | A1 * | 3/2004 | Kawanishi | 313/586 |
| 2005/0082958 | A1 * | 4/2005 | Su et al. | 313/292 |

FOREIGN PATENT DOCUMENTS

| | | |
|---|---|---|
| JP | 10-149771 | 6/1998 |
| JP | 11-96921 | 4/1999 |
| JP | 2000-195431 | 7/2000 |
| JP | 2001-135240 | 5/2001 |
| JP | 2001-236890 | 8/2001 |
| JP | 2001-345054 | 12/2001 |
| JP | 2002-83545 | 3/2002 |
| JP | 2003-157773 | 5/2003 |

(Continued)

OTHER PUBLICATIONS

Korea Patent Abstract, Publication No. 1020020075186 A, Published Oct. 4, 2002, in the name of Hashimoto Yasunobu.

(Continued)

*Primary Examiner*—Nimeshkumar Patel
*Assistant Examiner*—Anthony T Perry
(74) *Attorney, Agent, or Firm*—Christie, Parker & Hale, LLP

(57) ABSTRACT

A plasma display panel includes a first substrate, and a second substrate opposing the first substrate. A plurality of address electrodes are formed on the first substrate along a first direction, and a plurality of barrier ribs are mounted between the first and second substrates and defining a plurality of discharge cells that are formed into a plurality of rows along a second direction which is substantially perpendicular to the first direction. Non-discharge regions are formed between the respective rows of the discharge cells, and a plurality of transverse barrier ribs are formed along the second direction respectively within the non-discharge regions. Each of a plurality of phosphor layers is formed in a respective one of the discharge cells. Display electrodes are formed on the second substrate. At least one end of each of the transverse barrier ribs includes an annular branched segment.

20 Claims, 6 Drawing Sheets

FOREIGN PATENT DOCUMENTS

| | | | | |
|---|---|---|---|---|
| JP | 2004 103419 | | | 4/2004 |
| JP | 2004 103562 | | | 4/2004 |
| KR | 2002026040 | A | * | 4/2002 |
| KR | 2002-0075186 | | | 10/2002 |

OTHER PUBLICATIONS

Patent Abstract of Japan, Publication No. 1998-149771, Published on Jun. 2, 1998, in the name of Yatsuda, et al.
Patent Abstracts of Japan, Publication No. 11-096921 dated Apr. 9, 1999 in the name of Tetsuyoshi Tomioka et al.
Patent Abstracts of Japan, Publication No. 2000-195431 dated Jul. 14, 2000 in the name of Toshihiro Komaki et al.
Patent Abstracts of Japan, Publication No. 2001-135240 dated May 18, 2001 in the name of Tetsuya Matsumoto et al.
Patent Abstracts of Japan, Publication No. 2001-236890 dated Aug. 31, 2001 in the name of Kazutoshi Morikawa et al.
Patent Abstracts of Japan, Publication No. 2001-345054 dated Dec. 14, 2001 in the name of Ko Sano et al.
Patent Abstracts of Japan, Publication No. 2002-083545 dated Mar. 22, 2002 in the name of Yasuhiko Kunii et al.
Patent Abstracts of Japan, Publication No. 2003-157773 dated May 30, 2003 in the name of Tomohiro Kimura et al.
Patent Abstracts of Japan, Publication No. 2004-103419 dated Apr. 2, 2004 in the name of Yoshitaka Kawanishi.
Patent Abstracts of Japan, Publication No. 2004-103562 dated Apr. 2, 2004 in the name of Woo-Tae Kim et al.

* cited by examiner

PLASMA DISPLAY PANEL

CROSS-REFERENCE TO RELATED APPLICATION

The present application claims priority to and the benefit of Korean Patent Application No. 10-2004-0029915 filed on Apr. 29, 2004 in the Korean Intellectual Property Office, the entire content of which is incorporated herein by reference.

BACKGROUND OF THE INVENTION

1. Field of the Invention

The present invention relates to a plasma display panel (PDP), and more particularly, to a PDP having a structure in which each discharge cell is independently defined by barrier ribs formed between two substrates.

2. Description of the Related Art

A PDP is a display device that displays images through the excitation of phosphors. Vacuum ultraviolet (VUV) rays emitted through plasma discharge are used to excite the phosphors. The PDP is experiencing ever-increasing widespread use because of its thin profile and ability to be made with large screen sizes.

FIG. 7 shows a partial exploded perspective view of a conventional PDP. The conventional PDP includes a rear substrate 100 and a front substrate 110 provided opposing one another with a predetermined gap (i.e., discharge gap) therebetween. A plurality of address electrodes 101 are formed on a surface of the rear substrate 100 opposing the front substrate 110. The address electrodes 101 are formed in a stripe pattern along one direction, i.e., substantially along direction X of FIG. 7. A first dielectric layer 103 is formed on the rear substrate 100 covering the address electrodes 101, and a plurality of barrier ribs 105 are formed on the dielectric layer 103. The barrier ribs 105 are formed in a stripe pattern along direction X and at areas between the address electrodes 101. A red, green, or blue phosphor layer 107 is formed between each adjacent (or corresponding) pair of the barrier ribs 105. The phosphor layers 107 cover the dielectric layers 103 between the corresponding pairs of the barrier ribs 105, as well as side walls of the barrier ribs 105.

Formed on a surface of the front substrate 110 opposing the rear substrate 100 are a plurality of display electrodes 114. The display electrodes 114 are formed substantially along direction Y, that is, along a direction substantially perpendicular to the address electrodes 101. Further, each of the display electrodes 114 includes a pair of transparent electrodes 112 and a pair of bus electrodes 113, each of the bus electrodes 113 being formed on a corresponding one of the transparent electrodes 112. A second dielectric layer 116 and a Magnesium Oxide (MgO) protection layer 118 are formed on the front substrate 110 covering the display electrodes 114. Areas between the address electrodes 101 and the display electrodes 114 and delimited by the intersection of these elements form discharge cells.

With the above configuration, if an address voltage (Va) is applied between the address electrodes 101 and the display electrodes 114 to produce an address discharge, then a sustain voltage (Vs) is applied between a pair of the display electrodes 114 to produce a sustain discharge. The VUV rays generated during the sustain discharge then excite the corresponding phosphor layer 107 so that it emits visible light. The visible light passes through the front substrate 110 to thereby realize the display of images.

However, a problem with forming the display electrodes 114 in the stripe pattern and the barrier ribs 105 in the stripe pattern as described above is that crosstalk may occur between adjacent discharge cells, that is, between the discharge cells adjacent along direction Y. Further, since the discharge cells are communicating between each adjacent pair of the barrier ribs 105 (i.e., along direction X), there is the possibility of mis-discharge occurring between the adjacent discharge cells in this direction. To prevent this latter problem, the spacing between the display electrodes 114 along direction X is increased. However, this runs counter to efforts for improving PDP efficiency.

U.S. Pat. No. 5,640,068 discloses an attempt to overcome these drawbacks. Although stripe-type barrier ribs are used in the PDP disclosed in this patent, the transparent electrodes forming the display electrodes are structured to include a base portion extending horizontally and a projecting portion extending perpendicularly from the base portion so that a pair of the projecting portions is formed opposing one another at every pixel region. However, mis-discharge problems along the direction that the barrier ribs are formed still remain with this structure.

Another common configuration found in PDPs is to form the barrier ribs in a matrix structure, in which the barrier ribs are formed to perpendicularly intersect one another. Such a formation is used to overcome the drawbacks as discussed above and also to increase the area of deposition of the phosphor material in an effort to enhance illumination efficiency. The invention disclosed in Japanese Laid-Open Patent No. Heisei 10-149771 utilizes such a configuration. However, in the matrix type of barrier rib structure, since all areas except those directly corresponding to where the barrier ribs are formed are areas where discharge takes place, there are no regions in the PDP that absorb or disperse heat, only areas that generate heat. As a result, temperature differences result between discharge cells where discharge takes place and where discharge is not occurring. Such temperature differences not only adversely affect discharge characteristics, but are also the cause of other problems such as brightness differences and bright image sticking. (Bright image sticking refers to the phenomenon in which an illuminated region maintains its brightness level for a period relative to surrounding regions even after the illuminated region has been controlled to return to the pattern of its surrounding regions.)

Another prior art drawback relates to the manufacture of the PDP. The barrier ribs of the PDP are formed to a desired pattern using a barrier rib material through either a screen-printing process, or a conventional sandblasting process in which predetermined areas of a barrier rib material are removed following uniform deposition of the same. Drying and firing are also performed as part of patterning process of the barrier ribs. However, a problem with forming barrier ribs using these methods is that during the firing process, organic material contained in the barrier rib material is removed such that the barrier ribs shrink and are otherwise deformed.

Such deformation of the barrier ribs is particularly severe at end areas of the barrier ribs in non-display regions of the PDP. This is a result of a shrinking force being concentrated at the ends of the barrier ribs. An example of such deformation of barrier ribs is shown in FIG. 8, in which an end area of one of the barrier ribs 105 of FIG. 7 is shown prior to and following the firing process. As shown in FIG. 8, the end of the barrier rib 105 curls away from the rear substrate 100 to be separate therefrom. One negative consequence of such deformation of the barrier ribs is that the noise generated by the PDP may become severe.

SUMMARY OF THE INVENTION

In accordance with an embodiment of the present invention, a plasma display panel optimizes structures of barrier ribs for defining discharge cells to thereby enhance discharge efficiency, provides exhaust paths between the respective discharge cells to improve discharge efficiency, and prevents deformation of the barrier ribs during firing thereof to reduce a noise generated.

A plasma display panel of an embodiment of the present invention includes a first substrate; a second substrate provided opposing the first substrate; a plurality of address electrodes formed on the first substrate along a first direction; a plurality of barrier ribs mounted between the first and second substrates and defining a plurality of discharge cells that are formed into a plurality of rows along a second direction substantially perpendicular to the first direction; a plurality of non-discharge regions being formed between the respective rows of the discharge cells; a plurality of transverse barrier ribs, each of the transverse barrier ribs being formed along the second direction within the non-discharge regions; a plurality of phosphor layers each formed in a respective one of the discharge cells; and a plurality of display electrodes formed on the second substrate. At least one end of each of the transverse barrier ribs includes an annular branched segment.

Each of the transverse barrier ribs may include a line segment having a predetermined width, and an annular enlarged segment formed on at least one end of the line segment, the annular enlarged segment having an aperture.

A width of the portion of the transverse barrier rib forming the enlarged segment may be substantially the same as a width of the line segment, and an extreme distal end of the enlarged segment may have a predetermined radius of curvature.

An end of each of the discharge cells along the first direction may be formed having widths along the second direction that decrease as a distance from the center of a respective one of the discharge cells is increased.

Each of the display electrodes may include a bus electrode extending along the second direction and mounted outside an edge of a respective one of the discharge cells, and a protruding electrode extended along the first direction toward the center of the respective one of the discharge cells. A pair of the bus electrodes may be mounted corresponding to each of the discharge cells such that a pair of the protruding electrodes is positioned opposing one another in an area corresponding to each of the discharge cells.

The plasma display panel may further include dummy barrier ribs extending from respective ends of the rows of the discharge cells in respective non-display regions, at least one of the enlarged segments of the transverse barrier ribs respectively being formed between a respective pair of the dummy barrier ribs.

In view of the foregoing, the structures of the barrier ribs are optimized to increase discharge efficiency. Also, the temperature over the entire plasma display panel is made more uniform by the presence of the non-discharge regions to thereby prevent bright image sticking, which results from the concentration of heat in specific areas. The non-discharge regions also act as paths through which contents in the plasma display panel may be exhausted to thereby improve exhaust efficiency. Finally, a deformation of the barrier ribs during firing of the barrier ribs is prevented to thereby reduce noise generated by the plasma display panel.

DETAILED DESCRIPTION

Exemplary embodiments of the present invention will now be described with reference to the drawings.

Figure 1:
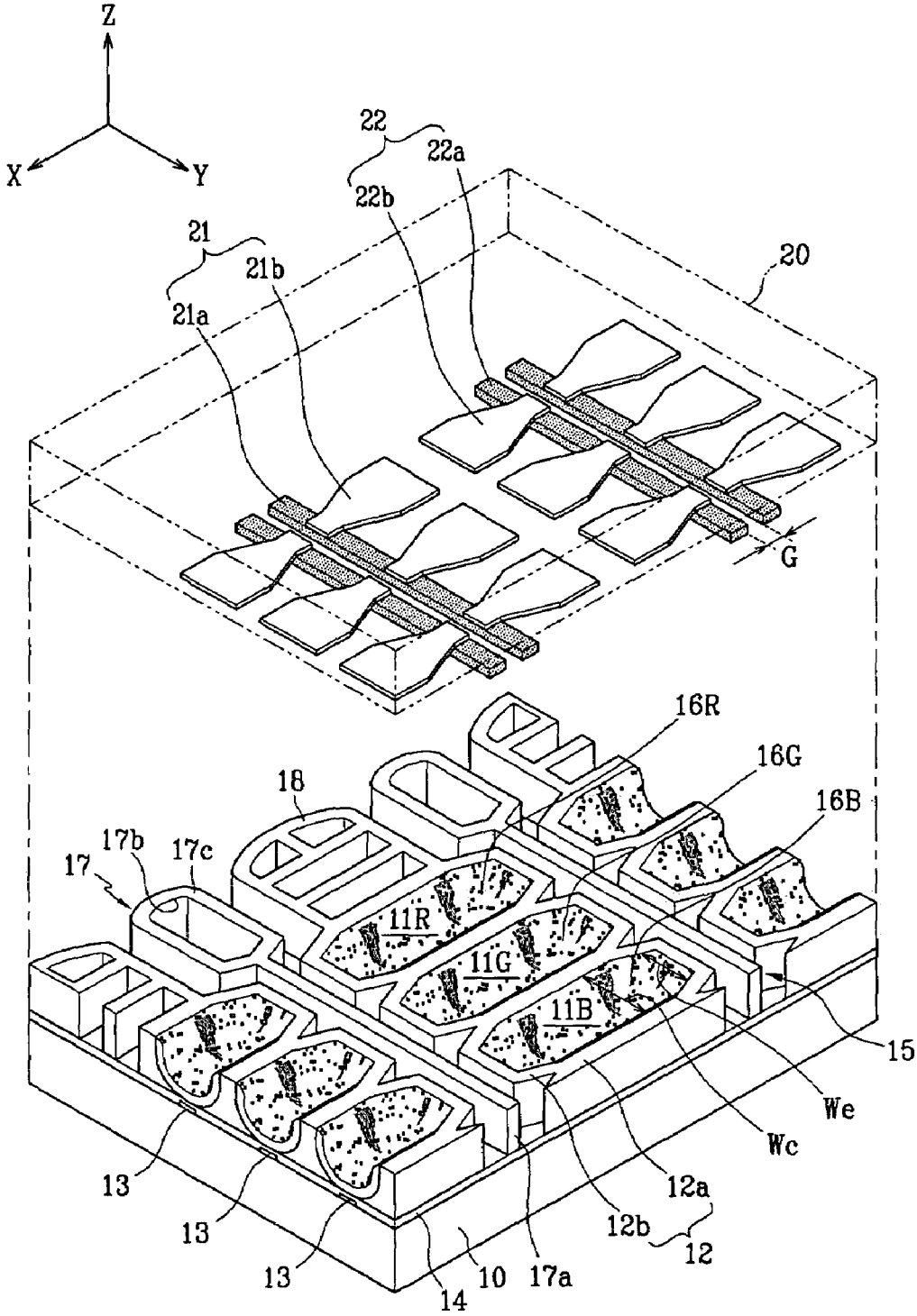
FIG. 1 is a partial exploded perspective view of a plasma display panel according to a first exemplary embodiment of the present invention.
Figure 2:
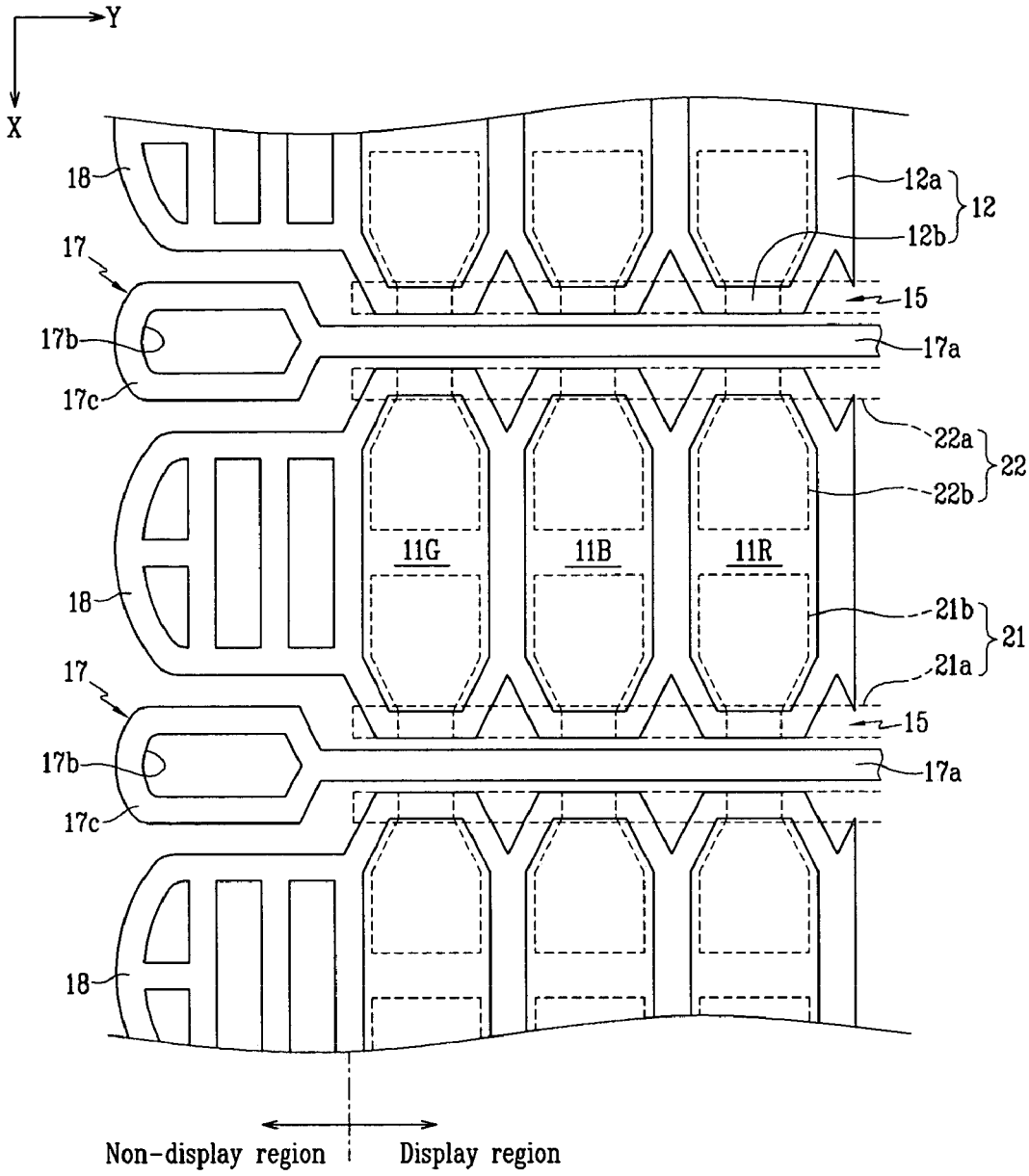
FIG. 2 is a partial plan view of the plasma display panel of FIG. 1.

FIG. 1 is a partial exploded perspective view of a plasma display panel (PDP) according to a first exemplary embodiment of the present invention, and FIG. 2 is a partial plan view of the PDP.

With reference to the drawings, the PDP according to the first exemplary embodiment of the present invention includes a first substrate 10 and a second substrate 20 provided opposing one another with a predetermined gap therebetween. Formed on a surface of the first substrate 10 opposing the second substrate 20 are a plurality of address electrodes 13. The address electrodes 13 are formed in a stripe pattern along a first direction, which is perpendicular to a second direction. The first direction along which the address electrodes 13 extend substantially corresponds to direction X in FIG. 1. In the description to follow, directions X and Y (first and second directions) will be referred to for convenience, with the understanding that they respectively correspond substantially to the direction along which the address electrodes 13 are formed and the direction perpendicular to the direction along which the address electrodes 13 are formed and the present invention is not thereby limited.

A first dielectric layer 14 is formed on the first substrate 10 covering the address electrodes 13. Further, main barrier ribs 12 are formed on the first dielectric layer 14 defining a plurality of independently formed discharge cells 11R, 11G, 11B in the gap between the first and second substrates 10, 20. In the first exemplary embodiment, the main barrier ribs 12 are formed defining a plurality of rows of the discharge cells 11R, 11G, 11B along direction Y, and a predetermined spacing is provided between adjacent rows. Each spacing between the adjacent rows of the discharge cells 11R, 11G, 11B represents a non-discharge region 15, and it therefore follows that the non-discharge regions 15 extend along direction Y.

The discharge cells 11R, 11G, 11B are filled with a discharge gas when the PDP is fully assembled, and define areas where discharge takes place with the application of an address voltage and a sustain voltage. The non-discharge regions 15, on the other hand, define areas where no voltage is applied, and where no discharge or illumination occurs.

In the first exemplary embodiment, each of the discharge cells 11R, 11G, 11B is formed to optimize the diffusion of discharge gas. That is, areas of each of the discharge cells 11R, 11G, 11B where there is a minimal level of sustain discharge and that are only slightly responsible for enhancing brightness are reduced in size. These areas of the discharge cells 11R, 11G, 11B are at the ends of the discharge cells 11R, 11G, 11B along direction X. In more detail, widths of the discharge cells 11R, 11G, 11B along direction Y are increasingly decreased as a distance from the centers of the discharge cells 11R, 11G, 11B is increased. This formation is continued for a predetermined distance, then the main barrier ribs 12 are formed extending along direction Y to close off ends of the discharge cells 11R, 11G, 11B.

As shown in FIG. 1, widths Wc along direction Y of the discharge cells 11R, 11G, 11B at centers thereof are greater than widths We along direction Y of the discharge cells 11R, 11G, 11B at ends thereof. That is, each of the widths is decreased as the distance to the center of the corresponding one of the discharge cells 11R, 11G, 11B is increased. As described above, this formation is continued for a predetermined distance, then the main barrier ribs 12 are formed extending along direction Y to close off the ends of the discharge cells 11R, 11G, 11B. Hence, when viewed along a direction approximately normal to either one of first and second substrates 10, 20, each of the ends of the discharge cells 11R, 11G, 11B is substantially trapezoidal in shape with one of its bases removed, and each of the discharge cells 11R, 11G, 11B as a whole is octagonal in shape. The main barrier ribs 12 include first barrier rib members 12*a* forming center regions of the discharge cells 11R, 11G, 11B, and second barrier rib members 12*b* forming the ends of the discharge cells 11R, 11G, 11B as described above.

Phosphor layers 16R, 16G, 16B are deposited within the discharge cells 11R, 11G, 11B, respectively.

The non-discharge regions 15 function to absorb heat generated in the PDP as a result of discharge occurring in the discharge cells 11R, 11G, 11B to thereby make the temperature over the entire PDP more uniform. Therefore, bright image sticking occurring in a conventional PDP as a result of the concentration of heat in certain areas is avoided. Since the non-discharge regions 15 are formed between the rows of the respective discharge cells 11R, 11G, 11B as channels that are unblocked along direction Y, they may be used as exhaust paths through which contents in the gap between the first and second substrates 10, 20 are exhausted following assembly, thereby increasing an exhaust conductance (or efficiency).

A transverse barrier rib 17 is formed in each of the non-discharge regions 15 between the rows of the discharge cells 11R, 11G, 11B. The transverse barrier ribs 17 extend substantially along direction Y.

Formed on a surface of the second substrate 20 opposing the first substrate 10 are first and second display electrodes 21, 22. In areas corresponding to each row of the discharge cells 11R, 11G, 11B, there are provided one of the first display electrodes 21 and one of the second display electrodes 22. Each of the first display electrodes 21 includes a bus electrode 21*a* extending along direction Y, and a plurality of protruding electrodes 21*b* extending from the bus electrode 21*a* in a direction toward the center of the corresponding discharge cell 11R, 11G, or 11B. Similarly, each of the second display electrodes 22 includes a bus electrode 22*a* extending along direction Y, and a plurality of protruding electrodes 22*b* extending from the bus electrode 22*a* in a direction toward the center of the corresponding discharge cell 11R, 11G, or 11B. With this configuration, a pair of the protruding electrodes 21*b*, 22*b* is provided opposing one another in each area corresponding to each of the discharge cells 11R, 11G, 11B. Although not appearing in the drawings, a second dielectric layer and an MgO protection layer are formed on the second substrate 20 covering the first and second display electrodes 21, 22.

The bus electrodes 21*a*, 22*a* substantially overlap the portions of the second barrier rib members 12*b* extending along direction Y and closing off the ends of the discharge cells 11R, 11G, 11B. Therefore, the bus electrodes 21*a*, 22*a* are formed neither in the discharge regions (i.e., areas corresponding to within the discharge cells 11R, 11G, 11B) nor in the non-discharge regions 15, thereby improving brightness of the PDP. The bus electrodes 21*a*, 22*a* are made of a metal material. Ends of the protruding electrodes 21*b*, 22*b* overlap the bus electrodes 21*a*, 22*a*, respectively, and the areas of the protruding electrodes 21*b*, 22*b* extending toward the center of the discharge cells 11R, 11G, 11B are formed substantially corresponding to the shape of the ends (or the trapezoidal ends) of the discharge cells 11R, 11G, 11B. The protruding electrodes 21*b*, 22*b* are made of a transparent material.

With the bus electrodes 21*a*, 22*a* overlapping portions of the second barrier rib members 12*b* as described above, undesirable discharge may occur between the bus electrodes 21*a*, 22*a* adjacent along direction X. The transverse barrier ribs 17 are disposed in the non-discharge regions 15 in the manner previously described to prevent such discharge from occurring. This is particularly useful when a gap G between adjacent ones of the bus electrodes 21*a*, 22*a* is about 140 μm or less, in which case there exists (without the presence of the transverse barrier ribs 17) a high possibility of discharge occurring between the bus electrodes 21*a*, 22*a*.

Figure 3:
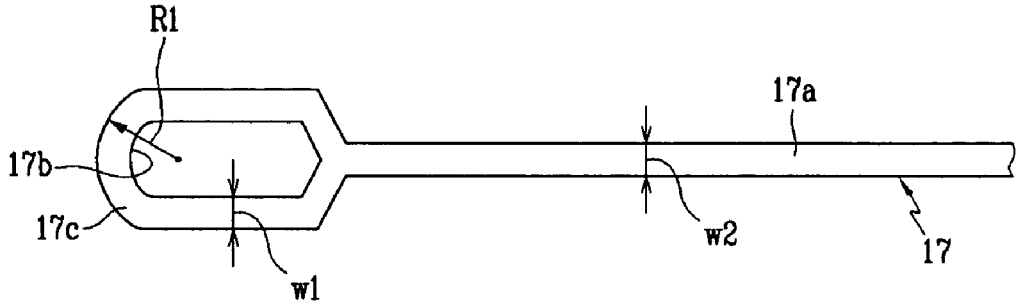
FIG. 3 is a partial enlarged view of a transverse barrier rib of the plasma display panel FIG. 2.

With reference to FIG. 3, each of the transverse barrier ribs 17 of the first exemplary embodiment includes an annular branched segment on at least one end thereof. This formation is used to minimize deformation of the ends of the transverse barrier ribs 17 occurring as a result of shrinking during the firing of barrier rib material. The ends of the transverse barrier ribs 17 should be positioned in regions where discharge does not occur.

In more detail, each of the transverse barrier ribs 17 includes a line segment 17*a* extended along and within the non-discharge regions 15, and an annular branched segment or an annular enlarged segment 17*c* formed at an end of the line segment 17*a* and that defines an aperture 17*b* therein. A width w1 of the portion of the transverse barrier rib 17 forming the enlarged segment 17*c* is substantially the same as a width w2 of the line segment 17*a*. Accordingly, the amount of deformation occurring during firing is substantially identical over all areas of the transverse barrier rib 17.

Figure 4:
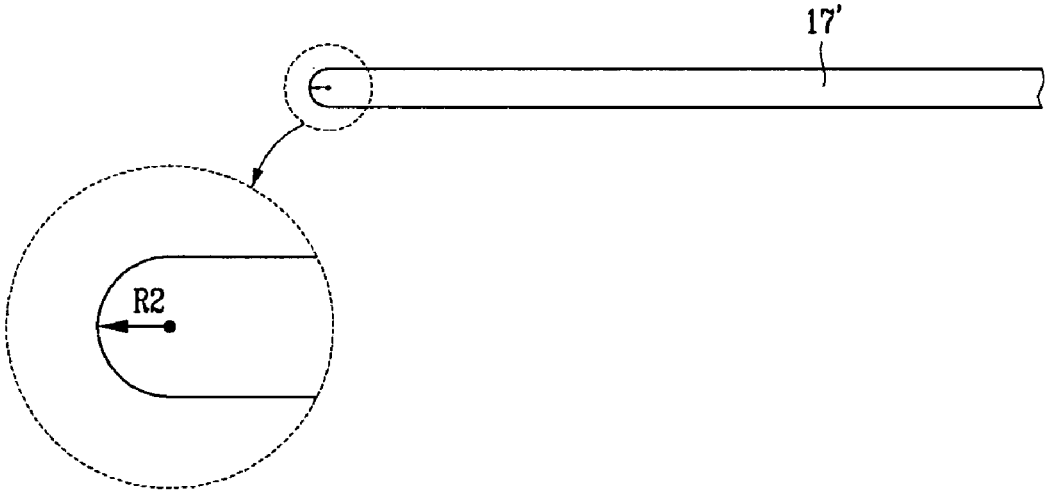
FIG. 4 is a schematic view illustrating a comparative example of a transverse barrier rib that does not include an enlarged segment.

In addition, an extreme distal end of the enlarged segment 17*c* is rounded with a predetermined degree of curvature. For comparison, a comparative transverse barrier rib 17' is shown in FIG. 4 that does not include an enlarged segment. A radius of curvature R1 of the end of the enlarged segment 17*c* of FIG. 3 is greater than a radius of curvature R2 of the transverse barrier rib 17' of FIG. 4. With this increased radius of curvature R1 of the end of the enlarged segment 17*c*, when the transverse barrier rib 17 undergoes shrinking during the firing process, the shrinking force that would normally be concentrated at the end of the transverse barrier rib 17 is distributed over the enlarged segment 17*c*, thereby preventing a curling of the transverse barrier rib 17 in a direction toward the second substrate 20 during firing of the barrier rib material. It is to be noted that the present invention is not limited to the particular formation of the enlarged segment 17*c* forming the aperture 17*b* as described above and as appearing in the drawings.

In addition to the structure described above and referring back to FIGS. 1 and 2, the PDP of the first exemplary embodiment further includes dummy barrier ribs 18 at ends of the rows of the discharge cells 11R, 11G, 11B. The dummy barrier ribs 18 extend from the first barrier rib members 12*a* at the ends of the rows of the discharge cells 11R, 11G, 11B to be positioned in a non-display region. The ends of the transverse barrier ribs 17, that is, the enlarged segments 17*c*, are formed between the dummy barrier ribs 18.

Figure 5:
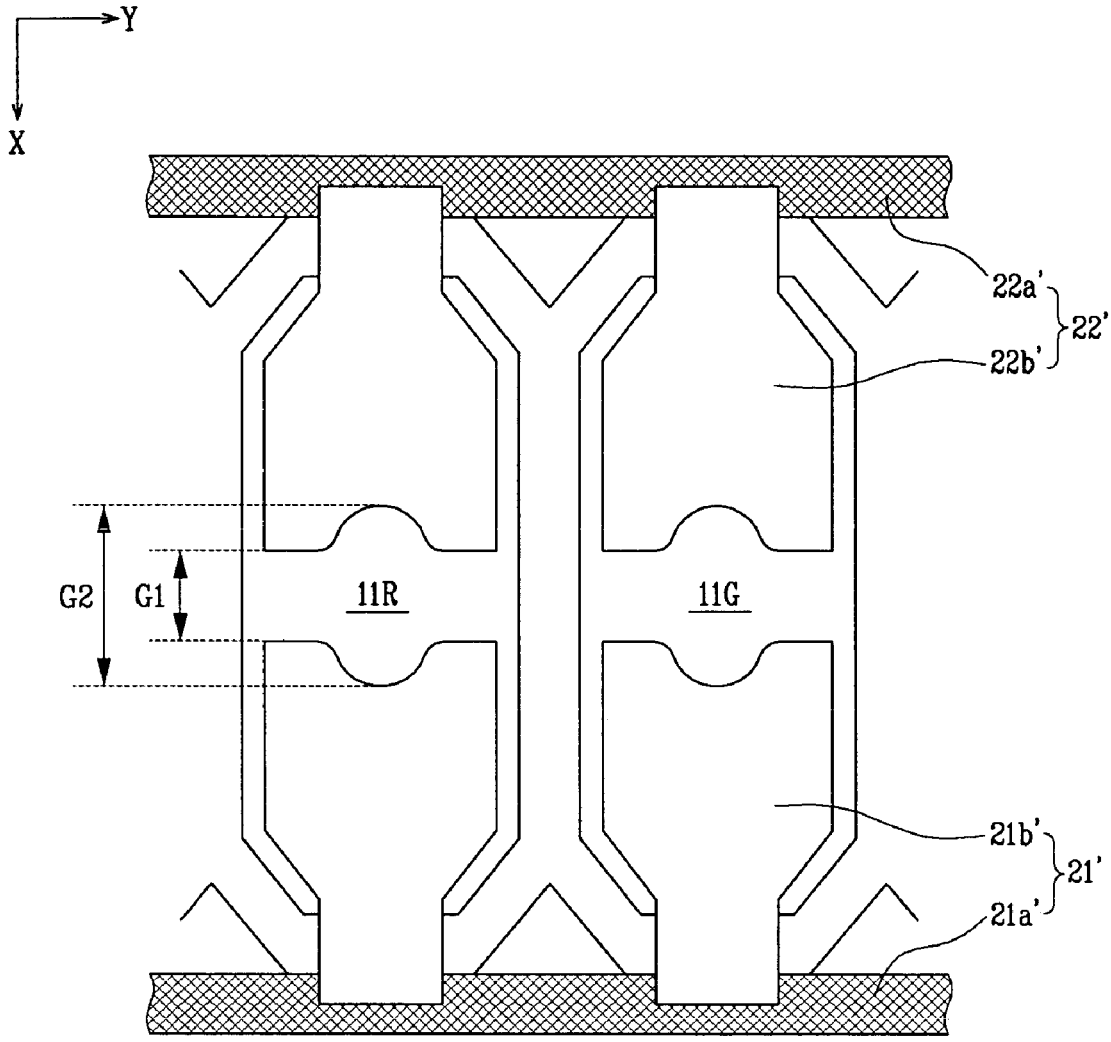
FIG. 5 is a partial plan view of a plasma display panel according to a second exemplary embodiment of the present invention.

FIG. 5 is a partial plan view of a PDP according to a second exemplary embodiment of the present invention. The PDP of the second exemplary embodiment is substantially identical to the PDP according to the first exemplary embodiment except for the configuration of the protruding electrodes 21*b*', 22*b*'. The different configuration is applied to increase discharge efficiency.

As shown in FIG. 5, distal ends of the protruding electrodes 21*b*', 22*b*' of the display electrodes 21', 22', respectively, are indented inwardly toward the bus electrodes 21*a*', 22*a*' at center areas of a width of the protruding electrodes 21*b*', 22*b*' formed along direction Y.

Accordingly, distances between the surfaces of the protruding electrodes 21*b*', 22*b*' opposing one another are varied. A gap G1 (i.e., a short gap) is formed between the opposing pair of the protruding electrodes 21*b*', 22*b*' at around areas corresponding to both sides of the indentations, and a gap G2 (i.e., a long gap) is formed between the opposing pair of the protruding electrodes 21*b*', 22*b*' at centermost points of the indentations. With this structure, plasma discharge, which is initiated at center areas of the discharge cells 11R, 11G, is more efficiently dispersed to other areas of the discharge cells 11R, 11G.

Figure 6:
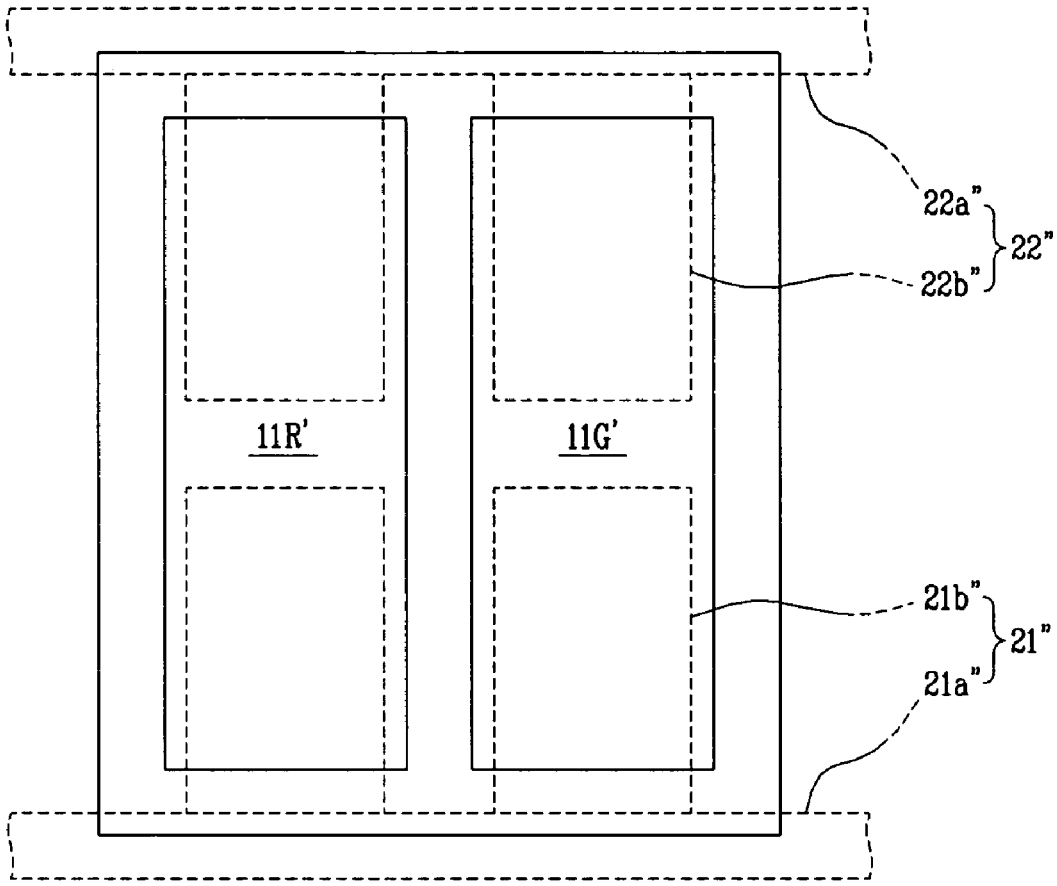
FIG. 6 is a partial plan view of a plasma display panel according to a third exemplary embodiment of the present invention.
Figure 7:
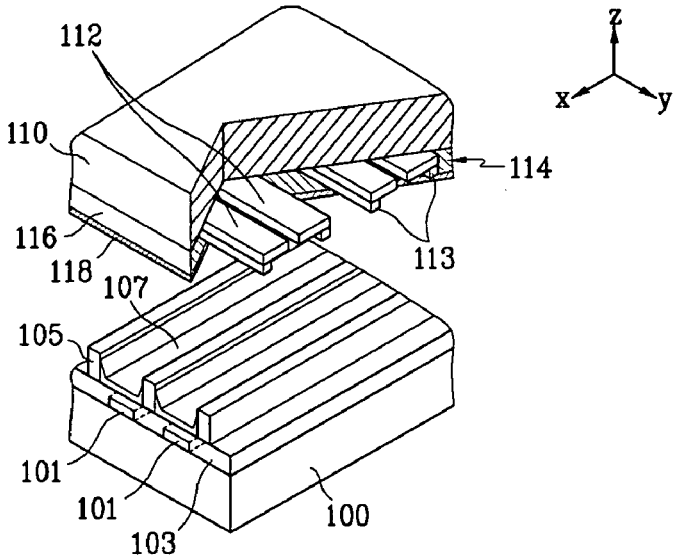
FIG. 7 is a partial exploded perspective view of a conventional plasma display panel.
Figure 8:
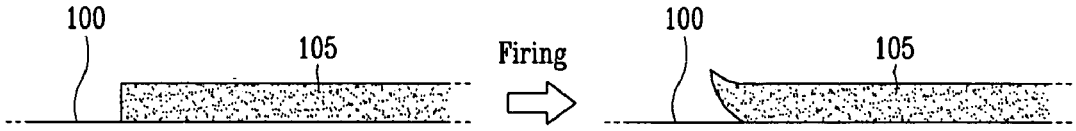
FIG. 8 is a schematic view of a conventional plasma display panel, illustrating curling of an end of a barrier rib following firing.

FIG. 6 is a partial plan view of a PDP according to a third exemplary embodiment of the present invention. In this exemplary embodiment, the discharge cells 11R', 11G' have a substantially quadrilateral planar shape. The protruding electrodes 21", 22*b*" are also quadrilateral, corresponding to the shape of the discharge cells 11R', 11B'. All other aspects of the third exemplary embodiment are substantially identical to the first exemplary embodiment.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A plasma display panel, comprising:

a first substrate;

a second substrate provided opposing the first substrate;

a plurality of address electrodes formed on the first substrate along a first direction;

a plurality of main barrier ribs mounted between the first substrate and the second substrate and defining a plurality of discharge cells formed into a plurality of rows along a second direction substantially perpendicular to the first direction;

a plurality of non-discharge regions formed between the respective rows of the discharge cells;

a plurality of transverse barrier ribs, each of the transverse barrier ribs extending along a distance of at least two of the discharge cells in the second direction and within the respective non-discharge regions;

a plurality of phosphor layers, each of the phosphor layers being formed in a respective one of the discharge cells; and a plurality of display electrodes formed on the second substrate, wherein at least one end of each of the transverse barrier ribs includes an annular branched segment.

2. The plasma display panel of claim 1, wherein each of the transverse barrier ribs includes a line segment having a width, and an annular enlarged segment on at least one end of the line segment, the annular enlarged segment having an aperture.

3. The plasma display panel of claim 2, wherein a width of the portion of the transverse barrier rib forming the enlarged segment is substantially the same as the width of the line segment.

4. The plasma display panel of claim 2, wherein an extreme distal end of the enlarged segment has a radius of curvature.

5. The plasma display panel of claim 2, further comprising a plurality of dummy barrier ribs extending from respective ends of the rows of the discharge cells in respective non-display regions, at least one of the enlarged segments of the transverse barrier ribs respectively being between a respective pair of the dummy barrier ribs.

6. The plasma display panel of claim 1, wherein the annular branched segment is an annular enlarged segment.

7. The plasma display panel of claim 1, wherein an end of each of the discharge cells along the first direction comprises widths along the second direction that decrease as a distance from the center of a respective one of the discharge cells is increased.

8. The plasma display panel of claim 7, wherein an end of each of the discharge cells has substantially a trapezoidal shape.

9. The plasma display panel of claim 1, wherein each of the display electrodes includes a bus electrode extending along the second direction and mounted outside an edge of a respective one of the discharge cells, and a protruding electrode extended along the first direction toward the center of the respective one of the discharge cells, and wherein a pair of the bus electrodes is mounted to correspond to each of the discharge cells such that a pair of the protruding electrodes is positioned opposing one another in an area corresponding to each of the discharge cells.

10. The plasma display panel of claim 9, wherein an end of each of the discharge cells has a first shape, and wherein a respective one of the protruding electrodes has a second shape substantially corresponding to the first shape of the end.

11. The plasma display panel of claim 9, wherein the center of a distal end of each of the protruding electrodes is indented toward a respective one of the bus electrodes such that a gap formed between each opposing pair of the protruding electrodes is varied.

12. The plasma display panel of claim 1, wherein each of the discharge cells has substantially an octagonal shape.

13. The plasma display panel of claim 1, wherein the annular branched segment is shaped to prevent a curling of a respective one of transverse barrier ribs.

14. A plasma display panel, comprising:

a first substrate;

a second substrate spaced apart from the first substrate;

a plurality of address electrodes located on the first substrate in a first direction;

a plurality of main barrier ribs located between the first substrate and the second substrate and defining a plurality of discharge cells formed into a plurality of rows along a second direction substantially perpendicular to the first direction;

a plurality of non-discharge regions located between the respective rows of the discharge cells;

a plurality of transverse barrier ribs, each of the transverse barrier ribs extending along a distance of at least two of the discharge cell in the second direction and within the respective non-discharge regions;

a plurality of phosphor layers, each of the phosphor layers being located in a respective one of the discharge cells; and a plurality of display electrodes located on the second substrate, wherein at least one end of each of the transverse barrier ribs includes an annular enlarged segment.

15. The plasma display panel of claim 14, wherein each of the transverse barrier ribs includes a line segment having a width, and the annular enlarged segment, and wherein the annular enlarged segment includes an aperture.

16. The plasma display panel of claim 15, wherein a width of the portion of the transverse barrier rib forming the enlarged segment is substantially the same as the width of the line segment.

17. The plasma display panel of claim 14, further comprising a plurality of dummy barrier ribs extending from respective ends of the rows of the discharge cells in respective non-display regions, at least one of the enlarged segments of the transverse barrier ribs respectively being between a respective pair of the dummy barrier ribs.

18. The plasma display panel of claim 14, wherein an end of each of the discharge cells along the first direction comprises widths along the second direction that decrease as a distance from the center of a respective one of the discharge cells is increased.

19. The plasma display panel of claim 14, wherein an end of each of the discharge cells has substantially a trapezoidal shape.

20. The plasma display panel of claim 14, wherein each of the display electrodes includes a bus electrode extending along the second direction and mounted outside an edge of a respective one of the discharge cells, and a protruding electrode extended along the first direction toward the center of the respective one of the discharge cells, wherein an end of each of the discharge cells has a first shape, and wherein a respective one of the protruding electrodes has a second shape substantially corresponding to the first shape of the end.

* * * * *

UNITED STATES PATENT AND TRADEMARK OFFICE

CERTIFICATE OF CORRECTION

PATENT NO. : 7,443,099 B2
APPLICATION NO. : 11/115526
DATED : October 28, 2008
INVENTOR(S) : Sung-Ho Song It is certified that error appears in the above-identified patent and that said Letters Patent is hereby corrected as shown below:

In the Claims

Column 9, line 5, Claim 14 Delete "cell",
Insert --cells--

Signed and Sealed this

Twenty-fourth Day of March, 2009

John Doll

JOHN DOLL
*Acting Director of the United States Patent and Trademark Office*